US010779698B2

(12) United States Patent
Krieg et al.

(10) Patent No.: US 10,779,698 B2
(45) Date of Patent: Sep. 22, 2020

(54) GAS-ASSISTED SCRAPING TOOL

(71) Applicant: EXAIR Corporation, Cincinnati, OH (US)

(72) Inventors: Ed Krieg, Milford, OH (US); Ryan Longshore, Covington, KY (US)

(73) Assignee: EXAIR CORPORATION, Cincinnati, OH (US)

( * ) Notice: Subject to any disclaimer, the term of this patent is extended or adjusted under 35 U.S.C. 154(b) by 171 days.

(21) Appl. No.: 15/715,550

(22) Filed: Sep. 26, 2017

(65) Prior Publication Data

US 2019/0090713 A1 Mar. 28, 2019

(51) Int. Cl.

| | |
|---|---|
| ***A47L 13/08*** | (2006.01) |
| ***B08B 1/00*** | (2006.01) |
| ***B08B 5/02*** | (2006.01) |
| ***B08B 7/04*** | (2006.01) |
| ***B44D 3/16*** | (2006.01) |

(52) U.S. Cl.

CPC ..... *A47L 13/08* (2013.01); *B08B 1/005* (2013.01); *B08B 1/007* (2013.01); *B08B 5/02* (2013.01); *B08B 7/04* (2013.01); *B44D 3/164* (2013.01)

(58) Field of Classification Search

CPC ..... A47L 13/08; B08B 1/005; B08B 1/007; B08B 5/02; B08B 7/04; B44D 3/164; B44D 3/166

USPC ..... 126/226; 15/105, 236.01, 401, 93.1; 156/761; 219/228; 30/140, 169, 404, 30/474, 476

See application file for complete search history.

(56) References Cited

U.S. PATENT DOCUMENTS

| | | | | | |
|---|---|---|---|---|---|
| 2,062,998 | A * | 12/1936 | Peterson | ..... | B44D 3/168 15/236.01 |
| 2,326,630 | A * | 8/1943 | Fagan | ..... | B44D 3/162 126/401 |
| 2,627,905 | A * | 2/1953 | Mangieri | ..... | B44D 3/166 126/401 |
| 2,698,653 | A * | 1/1955 | Hollaway | ..... | B44D 3/166 126/401 |
| 3,079,980 | A * | 3/1963 | Mihm | ..... | B44D 3/166 126/401 |

(Continued)

FOREIGN PATENT DOCUMENTS

| | | | | |
|---|---|---|---|---|
| DE | 2014 597 | 10/1971 | | |
| DE | 2014597 A1 * | 10/1971 | ..... | B44D 3/166 |

(Continued)

OTHER PUBLICATIONS

EP, Extended European Search Report and Opinion, European Patent Application No. 18192772.4, 11 pages (dated Feb. 27, 2019).

*Primary Examiner* — Joseph J Hail
*Assistant Examiner* — Arman Milanian
(74) *Attorney, Agent, or Firm* — Thompson Hine LLP

(57) ABSTRACT

A gas-assisted scraping tool includes a housing having a blade support with a cavity that is connectable to a source of a pressurized gas; a blade attached to and extending forwardly of the blade support; and a diffuser attached to the blade support and spacing the blade from the cavity, the diffuser shaped to direct a stream of the pressurized gas from within the cavity lengthwise along the blade and distribute the pressurized gas transversely across a width of the blade, whereby material loosened by the blade is blown away from an end of the blade by the stream of the pressurized gas.

20 Claims, 8 Drawing Sheets

(56) References Cited

U.S. PATENT DOCUMENTS

| | | | | | |
|---|---|---|---|---|---|
| 4,177,556 | A | * | 12/1979 | Galli, Jr. | B26B 21/446 30/41 |
| 4,274,676 | A | * | 6/1981 | Chapel | B28D 1/22 118/35 |
| 4,466,851 | A | | 8/1984 | Hoffman | |
| 5,050,805 | A | * | 9/1991 | Lloyd | B24C 1/003 239/424 |
| 5,072,486 | A | | 12/1991 | Guarascio | |
| 5,208,895 | A | * | 5/1993 | Hoover, Jr. | B44C 7/027 219/229 |
| 5,402,938 | A | | 4/1995 | Sweeney | |
| 6,822,197 | B1 | | 11/2004 | Mattfield | |
| 8,719,988 | B2 | | 5/2014 | Lundin | |
| 2005/0150127 | A1 | | 7/2005 | Arpke | |

FOREIGN PATENT DOCUMENTS

| | | |
|---|---|---|
| GB | 2 320 219 | 6/1998 |
| GB | 2 401 671 | 11/2004 |
| WO | 2017/054077 | 4/2017 |

* cited by examiner

GAS-ASSISTED SCRAPING TOOL

TECHNICAL FIELD

This disclosure relates to tools that utilize a compressed gas, and more particularly, to scraping tools that use a compressed gas to disperse material removed by the scraping tool blade.

BACKGROUND

Scraping tools come in many forms. A common component of most scraping tools is a blade having a sharp scraping edge. The blade may be attached to a handle that may be gripped by one or both hands of a user. The scraping tool blade edge is forced against the surface of a workpiece at an acute angle and reciprocated across the surface. The sharp edge of the blade thus scrapes away unwanted material, which may comprise old paint or varnish, residue, surface oxidation, or surface imperfections in the workpiece material itself. Such unwanted material accumulates as the action of the scraping tool blade continues to generate flakes or particles of the unwanted material being removed. If such accumulated scrapings of material are not removed from the work area, they may foul the area of the workpiece being scraped and reduce the effectiveness of the scraping tool blade in removing additional material.

Scraping tools have been developed to address the problem of accumulation of scraped material. Such scraping tools include a connection to a source of gas under pressure, such as pressurized air, that is directed over the surface of the workpiece to blow away the material removed from the workpiece by the scraping tool blade. Some gas-assisted scraping tools are complex in construction, requiring many parts that increase the overall cost of the scraping tool and are prone to corrosion and fouling. Other gas-assisted scraping tools are of a simple design, but do not direct a stream of the pressurized gas over a wide swath of cleared area that matches the area contacted by the full width of the scraping tool blade.

Accordingly, there is a need for a gas-assisted scraping tool that is low cost, of simple construction, is rugged, and provides a wide swath of cleared area adjacent the scraping blade edge.

SUMMARY

The disclosure describes a gas-assisted scraping tool that utilizes a pressurized fluid, which may take the form of a liquid or a compressed gas, such as compressed air, to blow away chips and/or material removed from the surface of the workpiece by the scraping tool. The disclosed scraping tool is of a relatively simple and low cost design, and may be disassembled for cleaning and/or replacement of its constituent parts with a minimum of effort. Further, the disclosed gas-assisted scraping tool includes a diffuser that distributes a stream of compressed gas across the entire width of the scraping tool blade, thus providing an efficient material removal function.

In an embodiment, a gas-assisted scraping tool includes a housing having a blade support with a cavity that is connectable to a source of a pressurized gas; a blade attached to and extending forwardly of the blade support; and a diffuser attached to the blade support and spacing the blade from the cavity, the diffuser shaped to direct a stream of the pressurized gas from within the cavity lengthwise along the blade and distribute the pressurized gas transversely across a width of the blade, whereby material loosened by the blade is blown away from an end of the blade by the stream of the pressurized gas.

In another embodiment, a gas-assisted scraping tool includes a housing having a blade support, the blade support having a rear wall, a pair of opposing side walls, a top wall, and a front lip, all defining a portion of a cavity that is connectable to a source of a pressurized gas, and together forming a continuous, flat mounting surface; a blade attached to and extending forwardly of the blade support; a flat, plate-shaped diffuser abutting the continuous, flat mounting surface of the blade support; and wherein the diffuser is shaped to direct a stream of the pressurized gas outwardly from the cavity between the blade and the front lip in a lengthwise direction along an adjacent surface of the blade and distribute the compressed gas transversely across a width of the adjacent surface of the blade, whereby material loosened by the blade is blown away from an end of the blade by the compressed gas.

In yet another embodiment, a method of making a gas-assisted scraping tool includes forming a housing having a blade support, and forming a cavity in the blade support that is connectable to a source of a compressed gas such that the cavity can be filled with the compressed gas; attaching a blade to the blade support such that the blade extends forwardly of the blade support; and attaching a diffuser to the blade support such that the diffuser or the blade covers the cavity, wherein the diffuser is shaped to direct a stream of the pressurized gas from the cavity lengthwise along the blade and distribute the pressurized gas transversely across a width of the blade, whereby material loosened by the blade is blown away from an end of the blade by the stream of the pressurized gas.

Other objects and advantages of the disclosed gas-assisted scraping tool will be apparent from the following description, the accompanying drawings, and the appended claims.

DETAILED DESCRIPTION

Figure 1:
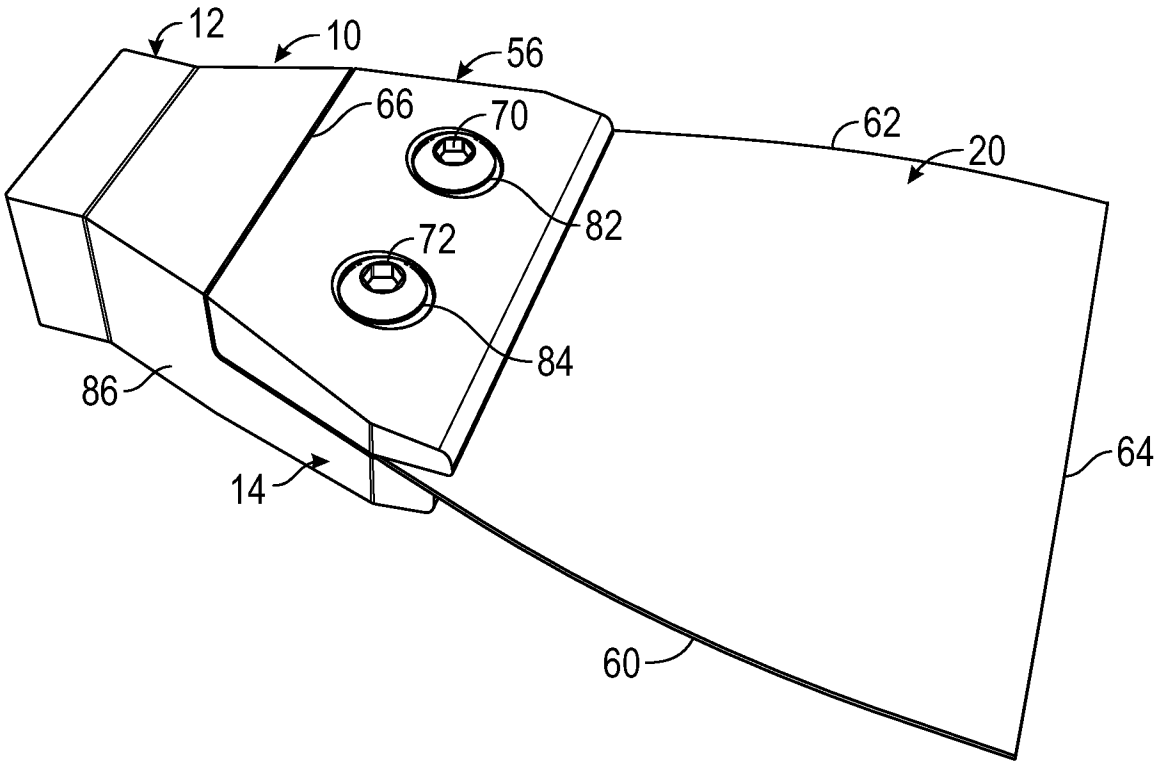
FIG. 1 is a perspective view of the underside of an embodiment of the disclosed gas-assisted scraping tool.

As shown in FIGS. 1, 2, 3, and 4, in an exemplary embodiment, the gas-assisted scraping tool, generally designated 10, may include a housing 12 having a blade support 14. The blade support may have a cavity 16 that is connectable to a source 18 of a pressurized fluid, which may take the form of a gas or a liquid. The source 18 may take the form of a tank of gas or liquid under pressure, an accumulator, and/or a compressor. The gas may include atmospheric air, and/or an inert gas, such as nitrogen. The liquid may be water, water mixed with a soap or cleaning solution, or a solvent. In an exemplary embodiment, the source 18 is pressurized gas at a pressure above atmospheric, and the pressure may be selected or adjusted by a throttle or valve (not shown) by a user of the tool 10 to suit the application.

The gas-assisted scraping tool 10 also may include a blade 20 that is attached to and extends forwardly of the blade support 14. The scraping tool 10 also may include a diffuser 22 that is attached to the blade support 14 and that covers the cavity 16. The blade 20 and diffuser 22 may be flat and plate shaped, and the diffuser 22 may be shaped to seat upon and cover the cavity 16 and lie flat against the base of the blade, as shown best in FIG. 2.

Figure 2:
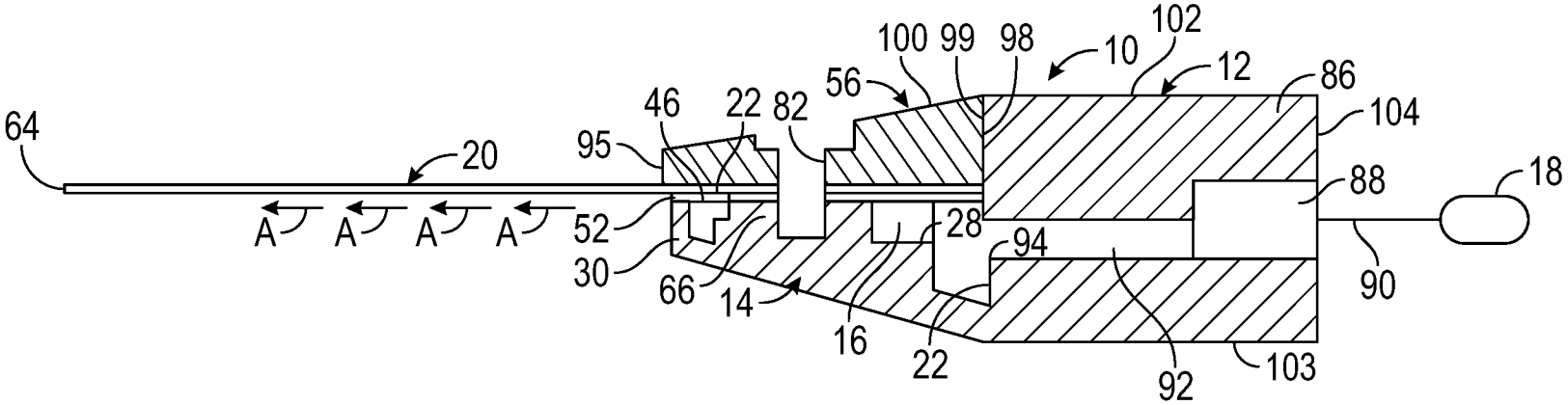
FIG. 2 is a side elevation, in section, of the gas-assisted scraping tool of FIG. 1, taken along line 2-2 of FIG. 2, and showing the retainer plate in section.
Figure 3:
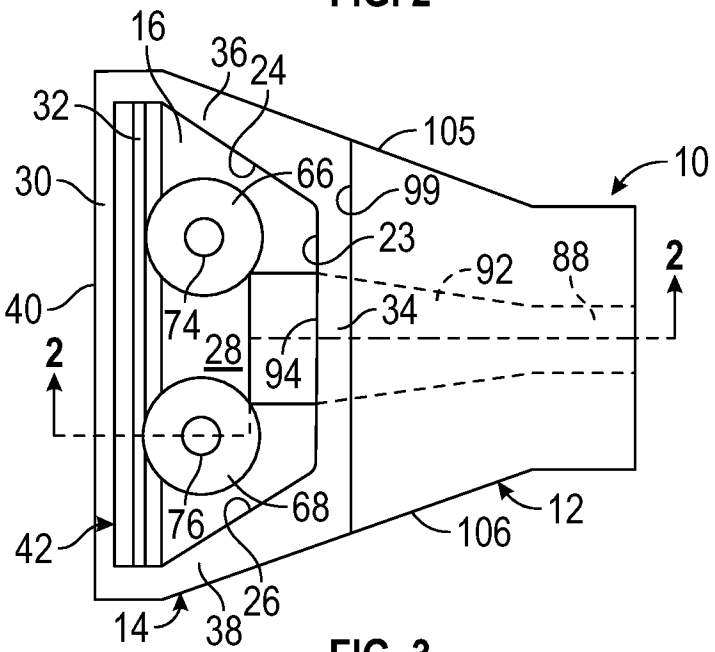
FIG. 3 is a top plan view of the housing of the gas-assisted scraping tool shown in FIG. 1, with the retainer plate and fasteners removed.

As shown in FIG. 3, in an embodiment, the cavity 16 may include a rear wall 23, a pair of opposing side walls 24, 26, a top wall 28, and a front lip 30, all of which are formed in the blade support 14. The opposing side walls 24, 26 may diverge outwardly in a downstream direction (i.e., in the direction of arrows A in FIG. 2) on the blade support 14 of the housing 12. The front lip 30 may extend transversely across the width of the front of the blade support between the opposing side walls 24, 26, and may be integral or unitary with the side walls. In an embodiment, the blade support 14 includes a baffle that reduces airflow out from the cavity 16 across the front lip 30. The baffle may take the form of a rectilinear raised rib 32 attached to and extending downwardly from the top wall 28 into the cavity 16. The raised rib 32 may extend between the opposing side walls 24, 26, and may be substantially parallel to the front lip 30 of the blade support 14.

The rear wall 23, opposing sidewalls 24, 26 and the front lip 30 each may include a flat or substantially flat mounting surface segment 34, 36, 38, and 40, respectively. The mounting surface segments 34-40 combine to form a continuous, flat mounting surface 42 that engages the diffuser 22, which in exemplary embodiments is flat and plate-shaped. Thus, the engagement between the diffuser 22 and the continuous, flat mounting surface 42 forms a wall of, and encloses the cavity 16, such that the cavity forms and acts as a plenum.

Figure 4:
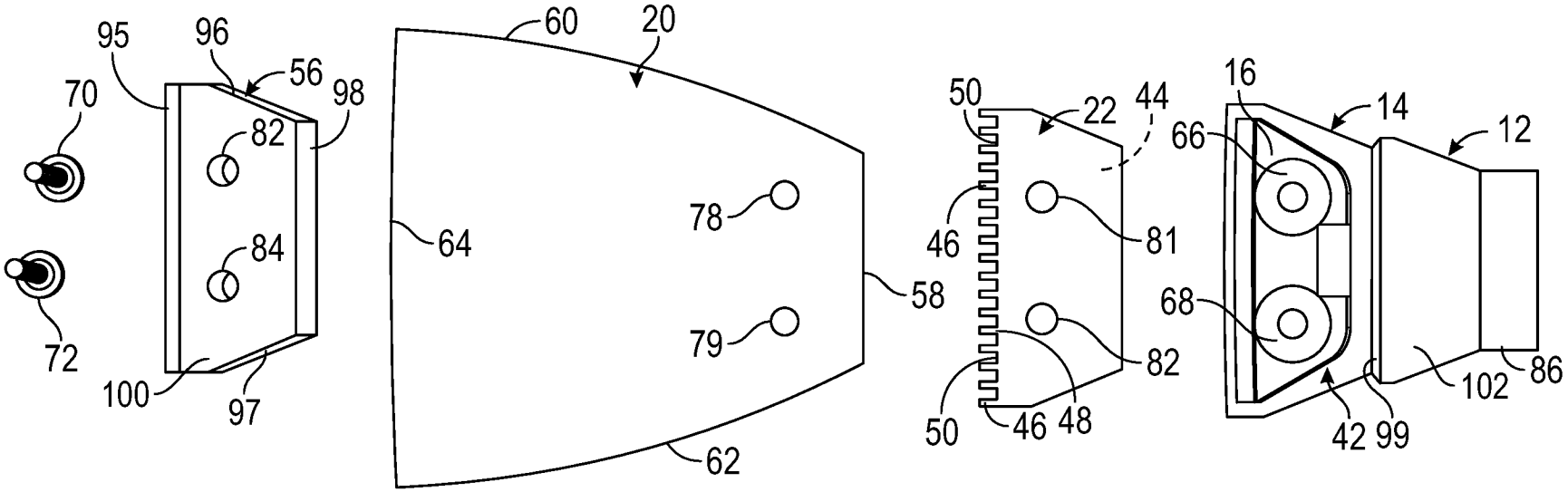
FIG. 4 is an exploded view showing the components of the gas-assisted scraping tool shown in FIG. 1.

As shown in FIG. 4, the diffuser 22 may form a bottom wall 44 of the cavity 16 when the diffuser 22 is placed against the continuous mounting surface 42 of the blade support 14. As shown in FIG. 4, the diffuser 22 may include a plurality of spaced teeth 46 extending across a forward edge 48 thereof, such that the teeth form gaps 50 therebetween. As shown in FIG. 2, the plurality of spaced teeth 46 are positioned between the blade 20 and the front lip 30 such that the gaps 50 (FIGS. 4 and 5) are bounded above and below by the front lip and the blade 20, respectively, and form a plurality of channels 52 to the ambient from the cavity 16 spaced across the width of the blade that direct streams, which collectively form a continuous stream, of the compressed gas from the cavity lengthwise along the upper surface of the blade, in the direction of arrows A in FIGS. 2 and 5.

Figure 5:
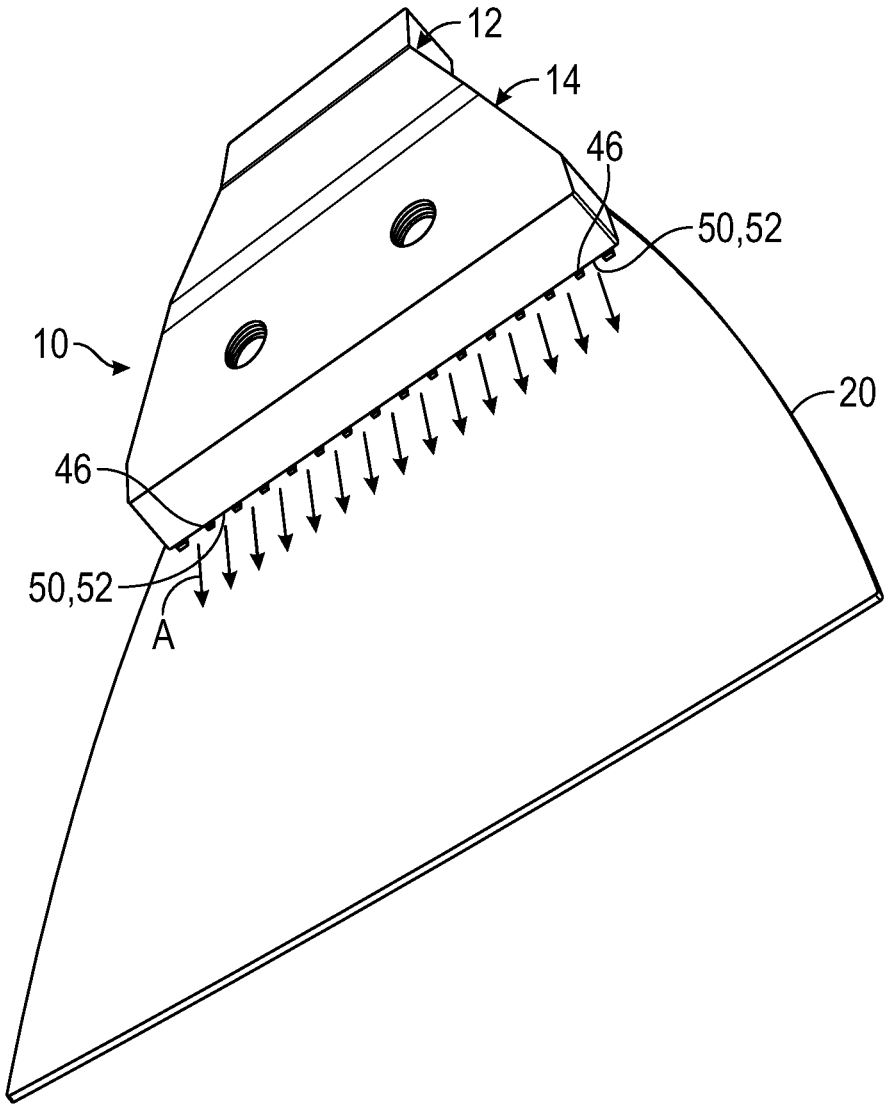
FIG. 5 is a top view in perspective of the gas-assisted scraping tool of FIG. 1.

As shown in FIG. 5, the channels 52 are spaced transversely across the width of the scraping tool blade 20. Thus, the channels 52 of the diffuser 22 distribute the streams of the pressurized gas evenly transversely across a width of the blade 20, whereby material loosened by the blade is blown away from the end of the blade by the stream of the pressurized gas across the entire width of the scraping tool blade. In the embodiment, the baffle 32 may be shaped to form a restriction with the bottom wall 44 of the cavity 16, which is a surface of the diffuser 22 and is obverse to the surface shown in FIG. 4, to reduce airflow from the cavity through the plurality of openings 50 and channels 52 to provide a predetermined amount of air flow across the width of the blade 20. In an embodiment, the teeth 46 are shaped to terminate rearwardly or inwardly of the forward face of the front lip 30.

As shown in FIGS. 1, 2, 4, and 5, the scraping tool 10 may include a retaining plate 56 that releasably clamps the scraping tool blade 20 against the diffuser 22, and the diffuser to the blade support 14 of the housing 12. The retaining plate 56 may have a trapezoidal, or generally trapezoidal, shape in plan view that corresponds to the shape of the mounting surface segments 34, 36, 38, and 40 of the continuous mounting surface 42. The shape of the retaining plate 56 is defined by a transverse, squared front wall 95, diverging side walls 96, 97, and a transverse rear wall 98 that may abut the forward wall 99 of the handle 86. The top wall 100 of the retaining plate 56 may taper in thickness from the upper surface 102 of the handle 86.

As shown in FIG. 4, the blade 20 may be a flat, plate-shaped blade having a straight rear edge 58, a pair of opposing and diverging side edges 60, 62, and a squared front edge 64. The rear edge 58 is shaped to abut the straight wall 66 of the housing 12. The front edge 64, in other exemplary embodiments, may be curvilinear, such as concave or convex, saw toothed, pointed or chisel shaped, or have an irregular shape. The edge of the front edge 64 may be squared, or may be beveled or sharpened to a knife or chisel edge. In an exemplary embodiment, the opposing side walls 24, 26 of the blade support 14 may be shaped to diverge in a forward direction that substantially, or in embodiments exactly, follows the portion of the outer profile of the scraping tool blade 20 that overlies the blade support. Similarly, the outer contour or profile of the retaining plate 56 may be shaped to follow, or substantially follow, the outer profile of the blade support 14.

As shown in FIGS. 2, 3, and 4, the top wall 28 of the blade support 14 may include at least one and optionally two cylindrical bosses 66, 68 extending into the cavity 16. The scraping tool 10 also may include at least one and optionally two fasteners 70, 72 that attach to the bosses 66, 68 to clamp the scraping tool blade 20 and diffuser 22 between the retaining plate 56 and the blade support 14. The fasteners 70, 72 may take the form of screws that are threaded into complementary threaded holes 74, 76 formed in the bosses 66, 68, respectively.

The screws 70, 72 pass through holes 78, 79 that are formed in the scraping tool blade 20 and diffuser 22. The screws 70, 72 may be retained within countersunk holes 82, 84 formed in the retainer plate 56. Thus, the blade 20 and diffuser 22 are retained against the blade holder 14 of the housing 12 by the clamping force of the retainer plate 56 against the mounting surface 42 of the blade holder, and by the positive mechanical connection of the screws 70, 72 passing through the holes 78, 79 of the blade and holes 81, 82 of the diffuser 22.

In an exemplary embodiment, the housing 12 may include a handle 86. The handle 86 may be shaped to be grasped by the hand of a user, and is positioned rearwardly of the blade support 14. The handle 86 may include a fitting 88, formed in a rearmost face, that connects to the source 18 of pressurized gas, for example by way of a hose 90, which in embodiments may include a regulator or valve to control gas pressure delivered to the scraper body 12. The hose 90 and fitting 88 may take the form of a quick-disconnect engagement, or a threaded bore for a simple male-female threaded connection. The handle 86 may include a channel 92 that connects the fitting 88 to the cavity 16 to convey pressurized gas from the fitting to an opening 94 in the rear wall 23 of the cavity. The handle 86 may be defined by a top surface 102, bottom surface 103, rear surface 104 and forward wall 99. The top surface 102 and bottom surface 103 may be joined by opposing side surfaces 105, 106 that may taper in width rearwardly toward rear surface 104.

In an exemplary embodiment, the source of pressurized gas 18 may provide atmospheric air under pressure through hose 90 to the fitting 88 to pressurize the cavity 16 so that gas exits the cavity through the channels 52 formed by the gaps 50 between the teeth 46 of the diffuser 22 and formed by the adjacent and abutting surface of the blade 20 and the front lip 30 of the blade support 14. In other embodiments, the compressed gas may include an inert gas such as nitrogen or carbon dioxide, or may be in the form of a fluid, such as water, a solvent, such as a petroleum solvent, or a detergent mixture. In still other embodiments, the source of pressurized gas may take the form of steam, so that the gas leaving the cavity 16 in the direction of arrows A in FIG. 2 may be in the form of steam that may heat and moisten the material being scraped by the blade 20.

A method for making the gas-assisted scraping tool 10 shown in FIGS. 1-5 may include forming a housing 12 having a blade support 14, and forming a cavity 16 in the blade support that is connectable to a source of pressurized gas 18, such that the cavity fills with pressurized gas. The housing 12 may be cast and/or machined from a single billet of material, which may be selected from a metal, such as steel, aluminum, or brass; a polymer, such as nylon; or a composite, such as carbon fiber reinforced plastic (CFRP). A scraping tool blade 20 is attached to the blade support 14 such that the scraping tool blade extends forwardly of the blade support. And finally, a diffuser 22 is attached to the blade support 14 such that the diffuser covers the cavity 16, wherein the diffuser is shaped to direct a stream of the pressurized gas from the cavity lengthwise along the blade 20 and distribute the pressurized gas transversely across a width of the blade, whereby material loosened by the blade is blown away from an end of the blade by the stream of pressurized gas.

The diffuser 22, which is placed against the continuous mounting surface 42 of the blade support 14, may be clamped between that supporting surface and the scraping tool blade 20 by the retaining plate 56 which is placed on the scraping tool blade. These components are held clamped together by the fasteners 70, 72 which are threaded into the threaded holes 74, 76 of the bosses 66, 68 extending upwardly from the top wall 28 of the blade support 14. The gas-assisted scraping tool 10 may be disassembled by removing the fasteners 70, 72 from the bosses 66, 68, at which point the retaining plate 56 may be removed and the scraping tool blade 20 and diffuser 22 separated from the blade support 14 of the housing 12. This ease of disassembly facilitates the replacement of a worn or broken blade 20, as well as substituting a blade 20 having a different front edge configuration, such as a saw tooth shape, an arcuate shape, a knife edge, and the like.

The channels 52 formed by gaps 50 between the teeth 46 of the diffuser 22 direct the pressurized gas from the cavity 16 across the width of the blade 20 evenly, in a lengthwise direction along an adjacent surface of the blade and distribute the compressed gas transversely across a width of the adjacent surface of the blade, whereby material loosened by the blade is blown away from an end of the blade by the compressed gas. The stream of pressurized gas flows in a direction that is substantially parallel to and against an adjacent surface of the blade 20 to disburse material removed from the surface of a workpiece by the blade that otherwise might collect on or adjacent the forward edge 64 of the scraping tool blade. The scraping motion of the disclosed scraping tool 10 may be effected by a user grasping the handle 86 of the housing 12 with their hand or hands and performing the scraping action manually. In other embodiments, the handle 86 may be attached to or integrated with an extended handle (not shown), or may be attached to or integrated with an articulated arm of a robotic device (not shown), where it would function as an end effector.

In an exemplary embodiment, the scraping tool 10 is positioned relative to a workpiece such that the channels 52 are on top of the blade 20, so that the stream of pressurized gas passes along the top of the tool against the upper surface of the blade (i.e., as shown in FIG. 5). However, there may be applications in which it is beneficial to position the tool 10 relative to a work surface such that the channels 52 convey the stream of pressurized gas from the cavity 16 along and under the adjacent surface of the blade 20 (i.e., the tool 10 is inverted, as shown in FIG. 1).

Figure 6:
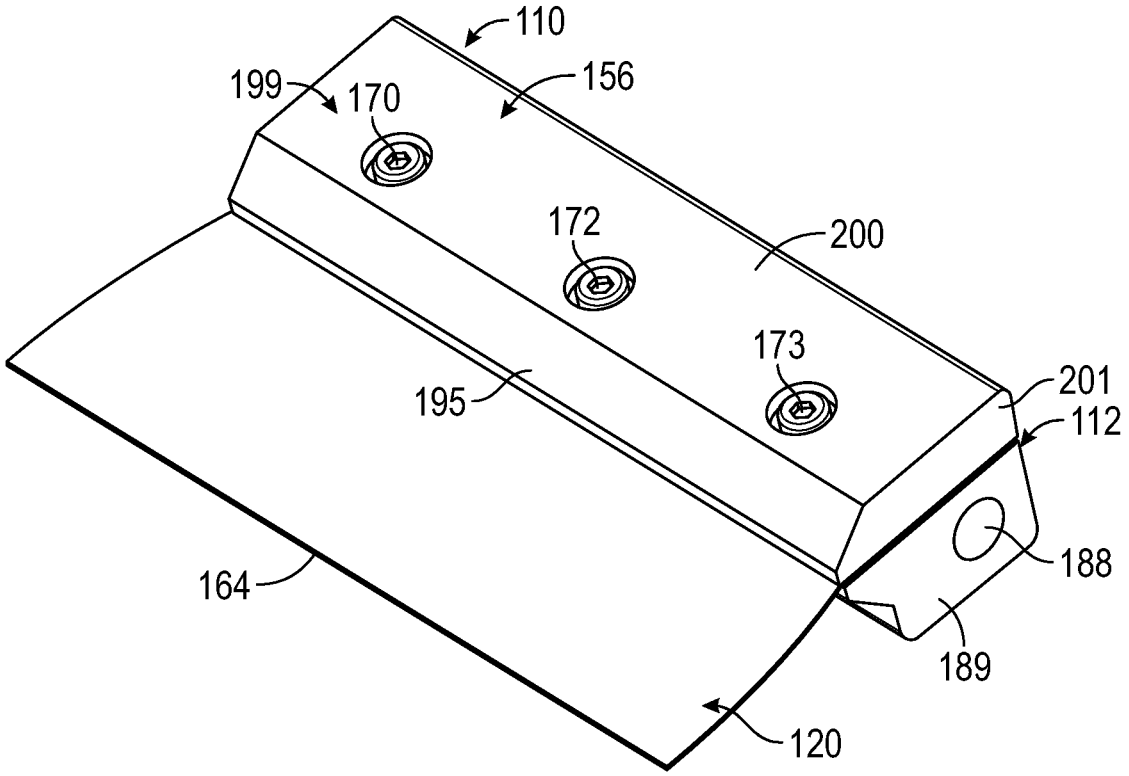
FIG. 6 is a perspective view of the underside of another embodiment of the disclosed gas-assisted scraping tool.
Figure 7:
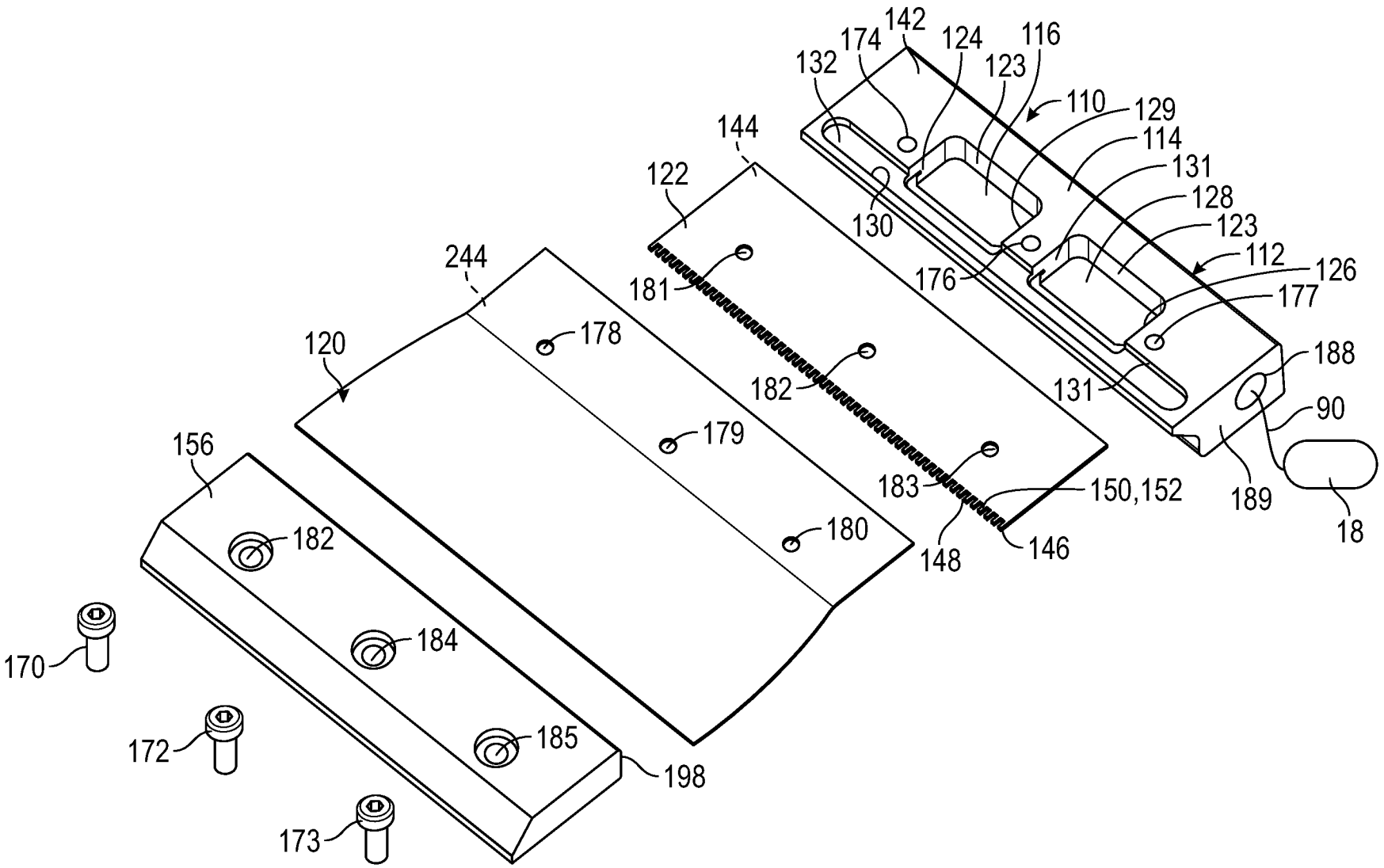
FIG. 7 is an exploded, perspective view of the embodiment of FIG. 6.
Figure 8:
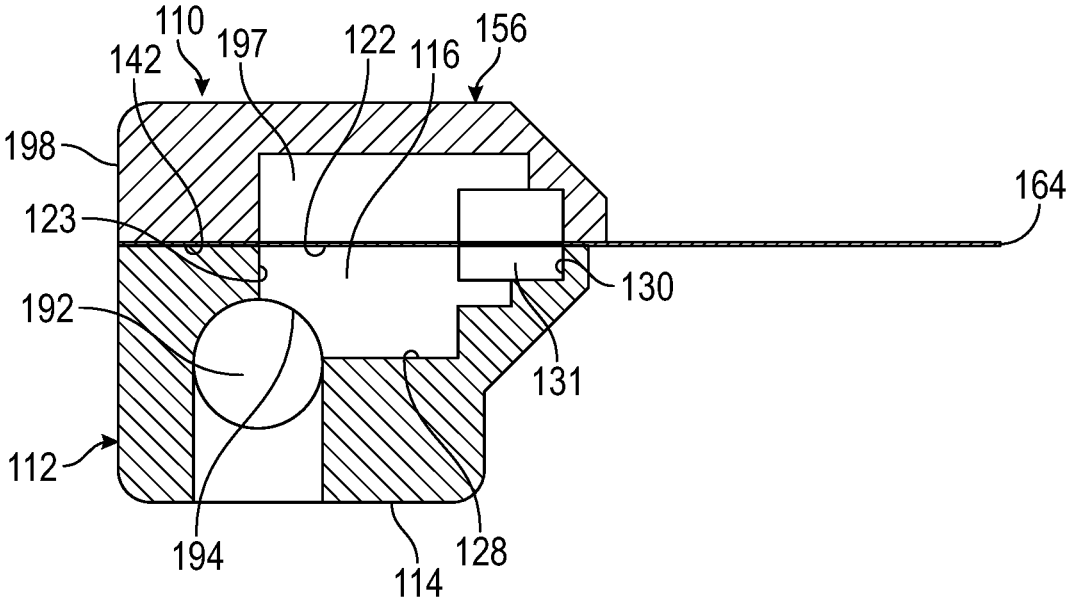
FIG. 8 is a side elevation, in section, of the embodiment of FIG. 6.

Another embodiment of the gas-assisted scraping tool, generally designated 110, is shown in FIGS. 6, 7, and 8. The tool 110 may include a housing 112 having a blade support 114. The blade support 114 may be cast and/or machined from a solid billet of material and include a cavity 116, which may be cast or machined into the blade support, that communicates with the source 18 of pressurized gas or liquid 18. The tool 110 also may include a blade 120 that is attached to and extends forwardly of the blade support 114. The blade 120 may be flat and plate shaped, having a straight rear edge 158, a pair of opposing and diverging side edges 160, 162, and a straight front edge 64.

The tool 110 may include a diffuser 122 that is attached to the blade support 114 and that covers the cavity 116. The diffuser 122 is positioned between the blade 120 and the blade support 114. The housing 112 may include a retaining plate 156 that clamps the blade 120 against the diffuser 122, and the diffuser against the blade support 114. The retaining plate 156 corresponds in width and length dimensions to the blade holder 114, having a top surface 200, a beveled front edge 195, a rear face 198, opposing sides 199, 201 and an interior cavity 197, which in embodiments may form part of the cavity 116 that receives compressed gas from channel 192. These components may be held together by retaining screws 170, 172, 173, which extend through retaining holes 182, 184, 185 in the retaining plate 156, aligned holes 178, 179, 180 in the blade 120, aligned holes 181, 182, 183 in the diffuser 122, and are threaded into holes 174, 176, 177 in the blade support 114.

In an embodiment, the cavity 116 may include a rear wall 123, a pair of opposing side walls 124, 126, a top wall 128, interior walls 129, 131, and a front lip 130. The interior walls 129, 131 interrupt rear wall 123 at a midpoint of the width of the blade support 114 and define a raised land for the screw hole 176. The cavity 116 may include a transverse channel 132 that extends parallel to the front lip 130. The transverse channel 132 may be shallower in depth (i.e., as measured in FIG. 8) than the portion of the cavity 116 defined by the side walls 124, 126, rear wall 123, and top wall 128, and thus may provide a restriction or baffle function. The blade support 114 may include a flat, or substantially flat, mounting surface 142 that surrounds the cavity 116, and in embodiments extends across the entire top surface of the blade support, including the raised land defined by walls 129, 131.

In an exemplary embodiment, the diffuser 122 is flat, or substantially flat, and plate shaped, and may form a bottom wall 144 of the cavity 116 when the diffuser is clamped against the continuous mounting surface 142 of the blade support 114 by the blade 120 and retaining plate 156. The diffuser 122 may include a plurality of spaced teeth 146 extending transversely across a forward edge of the diffuser, such that the teeth form gaps 150 therebetween that extend transversely across the width of the diffuser. In an embodiment, the gaps 150 are evenly shaped and spaced across the width of the diffuser. The diffuser 122 is shaped such that the gaps 150 form a plurality of channels 152 to the ambient from the cavity 116, so that streams of compressed gas from the cavity travel lengthwise along the blade 120.

The blade support 114 may include a fitting 188, formed in a side wall 189, as shown in FIGS. 6 and 7, and/or in a bottom wall 191 as shown in FIG. 8, of the blade holder, that may be connected to a source 18 of pressurized gas, for example, by way of a hose 190. The blade holder 114 may include a channel 192 that connects the fitting 188 to the cavity 116 to convey pressurized gas from the fitting to an opening 194 in the rear wall of the cavity.

Figure 9:
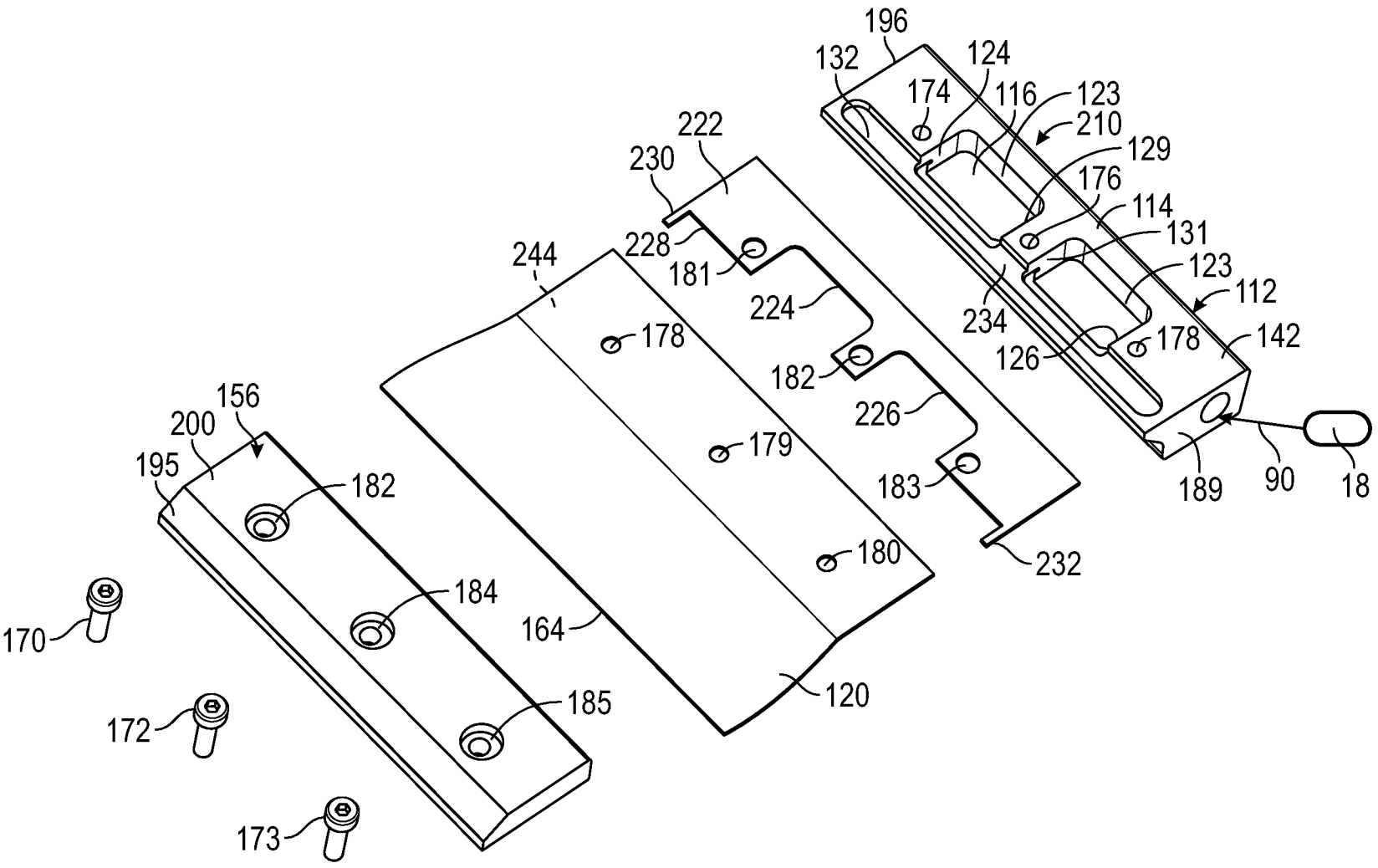
FIG. 9 is a perspective view of yet another embodiment of the disclosed gas-assisted scraping tool.

FIG. 9 shows yet another embodiment of the disclosed gas-assisted scraping tool, generally designated 210. Gas-assisted scraping tool 210 includes a blade support 114, blade 120, and retaining plate 156, which in embodiments are the same described for tool 110 of FIGS. 6-8. Diffuser 222 is shaped to cover continuous mounting surface 142, but includes cutouts 224, 226 that are shaped to conform to the rear walls 123, side walls 124, 126, and interior walls 129, 131. The diffuser 222 also includes a recess 228 bounded by side edge projections 230, 232 whose outer edges are aligned with the corresponding end walls 189, 196 of the blade support 114.

In an alternate embodiment, blade 120 may be provided with an opening (not shown) that provides communication between interior cavity 197 and cavity 116, and diffuser 122 may be provided with an opening (not shown) aligned with the blade opening that allows pressurized gas or fluid entering the cavity 116 to flow into and pressurized the interior cavity 197. Diffuser 122 and blade 120 may be reversed in orientation relative to the blade support 114 from that shown in FIG. 8 so that gas exits from the interior cavity 197 between the retaining plate 156 and the blade 120. In such an embodiment, the cavity 116 may be considered to communicate with and include interior cavity 197.

The diffuser 222 is placed beneath the scraper blade 120, and the diffuser and scraper blade are clamped against the blade holder 114 by the retaining plate 156 and retaining screws 170, 172, 173. The screws 170, 172, 173 pass through holes 182, 184, 185 in the retaining plate 156, holes 178, 179, 180 in scraper blade 120, holes 181, 182, 183 in diffuser 222, and are threaded into holes 174, 176, 178 of the blade holder 11. The diffuser 222 spaces the scraper blade 120 from the mounting surface 142 to form a continuous transverse gap 234, which may be coextensive with the transverse channel 132, between the portion of the mounting surface formed by the lip 130 and the immediately adjacent portion of the underside 244 of the scraper blade 120. Unlike the embodiments 10, 110 of FIGS. 1-8, the rear portion 244 of the blade 120 of scraper 210 itself forms a wall of the cavity 116 of the housing 112, and is spaced from the mounting surface 142 by the diffuser 222 to form the gap 234.

Compressed air or other gas entering the cavity 116 from the source 18 exits the cavity in a continuous, transverse sheet of air or gas along the scraper blade 120 toward the front edge 64. The absence of spaced teeth in the diffuser, such as spaced teeth 46, 146 of the embodiments of FIGS. 1-8, may provide a wider stream of air or gas along the blade 120. The gas-assisted scraping tools 110, 210 may be attached to a wand, pole, or other component to facilitate use by hand, or may be attached to a robotic arm as an end effector. The scraping tools 110, 210 function in a manner similar to the gas-assisted scraping tool 10 of FIGS. 1-5, namely, compressed gas is conveyed from a source of compressed gas 18 to the cavity 116 formed in the blade support 114, where it exits through channels 152 or transverse gap 234 formed by the diffuser 122, 222, respectively, and travels along the underside 244 of the length of the blade 120 (in the orientation shown in FIG. 9) toward the front edge 164, where it acts to blow away chips and other debris that may be loosened by the scraper blade 120.

While the forms of apparatus and methods disclosed and described herein constitute preferred embodiments of the gas-assisted scraping tool, it is to be understood that the invention is not limited to these precise structures and methods, and that changes may be made therein without departing from the scope of the invention.

What is claimed is:

1. A gas-assisted scraping tool, comprising:

a housing having a blade support, the blade support having a cavity that is connectable to a source of a pressurized gas;

a blade attached to and extending forwardly of the blade support; and a diffuser attached to the blade support and spacing the blade from the blade support, the diffuser being flat and plate shaped and attached to the blade support to enclose and form a top wall of the cavity, and wherein the diffuser is shaped to direct a stream of the pressurized gas from within the cavity lengthwise along the blade and distribute the pressurized gas transversely across a width of the blade, whereby material loosened by the blade is blown away from an end of the blade by the stream of the pressurized gas.

2. The gas-assisted scraping tool of claim 1, wherein the blade support includes a rear wall, a pair of opposing side walls, a top wall, and a front lip, which together with either the diffuser or the blade define the cavity.

3. A gas-assisted scraping tool, comprising:

a housing having a blade support, the blade support having a cavity that is connectable to a source of a pressurized gas;

a blade attached to and extending forwardly of the blade support, wherein the blade support includes a rear wall, a pair of opposing side walls, a top wall, and a front lip, which together with either the diffuser or the blade define the cavity; and a diffuser attached to the blade support and spacing the blade from the cavity, the diffuser is flat and plate shaped, includes a plurality of spaced teeth extending across a forward edge thereof forming gaps therebetween, and is attached to the blade support to enclose and form a top wall of the cavity, and the plurality of spaced teeth are positioned between the scraping tool blade and the front lip such that the gaps, bounded by the scraping tool blade and the front lip, form a plurality of channels from the cavity spaced across the width of the scraping tool blade that direct the stream of the pressurized gas from the cavity lengthwise along the scraping tool blade;

wherein the diffuser is shaped to direct a stream of the pressurized gas from within the cavity lengthwise along the blade and distribute the pressurized gas transversely across a width of the blade, whereby material loosened by the blade is blown away from an end of the blade by the stream of the pressurized gas.

4. The gas-assisted scraping tool of claim 3, wherein the blade support includes a baffle that reduces air flow through the plurality of openings.

5. The gas-assisted scraping tool of claim 4, wherein the baffle includes a raised rib attached to and extending downwardly from the top wall into the cavity that forms a restriction with the diffuser to flow of pressurized gas from the cavity through the channels.

6. The gas-assisted scraping tool of claim 5, wherein the raised rib extends between the opposing side walls and is substantially parallel to the front lip.

7. The gas-assisted scraping tool of claim 3, wherein the rear wall, the opposing side walls, and the front lip each includes a mounting surface segment that engages the diffuser to close the cavity.

8. The gas-assisted scraping tool of claim 7, wherein the mounting surface segments combine to form a continuous, flat mounting surface that engages the flat, plate-shaped diffuser.

9. The gas-assisted scraping tool of claim 8, wherein the teeth are shaped to terminate rearwardly of a forward face of the front lip.

10. The gas-assisted scraping tool of claim 1, further comprising a retaining plate that releasably clamps the scraping tool blade against the diffuser, and the diffuser to the housing.

11. The gas-assisted scraping tool of claim 2, wherein the pair of opposing side walls diverge in a forward direction that substantially follows a portion of an outer profile of the scraping tool blade that overlies the blade support.

12. The gas-assisted scraping tool of claim 10, wherein the retaining plate is shaped to follow an outer profile of the blade support.

13. The gas-assisted scraping tool of claim 1, wherein the housing includes a handle.

14. The gas-assisted scraping tool of claim 13, wherein the handle is positioned rearwardly of the blade support and includes a fitting that connects to the source of pressurized gas.

15. The gas-assisted scraping tool of claim 14, wherein the handle includes a channel that connects the fitting to the cavity to convey compressed gas from the fitting to an opening in a rear wall of the cavity.

16. A gas-assisted scraping tool, comprising:

a housing having a blade support, the blade support having a rear wall, a pair of opposing side walls, a top wall, and a front lip, all defining a portion of a cavity that is connectable to a source of a pressurized gas, and together forming a continuous, flat mounting surface;

a blade attached to and extending forwardly of the blade support;

a flat, plate-shaped diffuser abutting the continuous, flat mounting surface of the blade support, the diffuser spacing the blade from the blade support; and wherein the diffuser is shaped to direct a stream of the pressurized gas outwardly from the cavity between the blade and the front lip in a lengthwise direction along an adjacent surface of the blade and distribute the compressed gas transversely across a width of the adjacent surface of the blade, whereby material loosened by the blade is blown away from an end of the blade by the compressed gas.

17. A method of making a gas-assisted scraping tool, the method comprising:

forming a housing having a blade support, and forming a cavity in the blade support that is connectable to a source of a compressed gas such that the cavity can be filled with the compressed gas;

attaching a blade to the blade support such that the blade extends forwardly of the blade support; and attaching a diffuser to the blade support such that the diffuser or the blade covers the cavity and spaces the blade from the blade support, wherein the diffuser is shaped to direct a stream of the pressurized gas from the cavity lengthwise along the blade and distribute the pressurized gas transversely across a width of the blade, whereby material loosened by the blade is blown away from an end of the blade by the stream of the pressurized gas.

18. The gas-assisted scraping tool of claim 1, wherein the diffuser includes a plurality of spaced teeth extending across a forward edge thereof forming gaps therebetween.

19. A gas-assisted scraping tool, comprising:

a housing having a blade support;

a blade attached to and extending forwardly of the blade support;

a diffuser attached to the blade support and spacing the blade from the cavity, the diffuser shaped to direct a stream of the pressurized gas from within the cavity lengthwise along the blade and distribute the pressurized gas transversely across a width of the blade, whereby material loosened by the blade is blown away from an end of the blade by the stream of the pressurized gas;

the blade support having a rear wall, a pair of opposing side walls, a top wall, and a front lip that together with either the diffuser or the blade define a cavity that is connectable to a source of a pressurized gas;

a retaining plate that releasably clamps the scraping tool blade against the diffuser, and the diffuser to the housing, wherein the top wall of the blade support includes at least one boss extending into the cavity; and at least one fastener that attaches to the at least one boss to clamp the scraping tool blade and the diffuser between the retaining plate and the blade support.

20. A gas-assisted scraping tool, comprising:

a housing having a blade support, the blade support having a front lip and a cavity that is connectable to a source of a pressurized gas;

a blade attached to and extending forwardly of the blade support; and a diffuser attached to the blade support and spacing the blade from the cavity, the diffuser including a plurality of spaced teeth extending across a forward edge thereof, forming gaps therebetween bounded by the blade and front lip to form a plurality of channels from the cavity to direct a stream of the pressurized gas from within the cavity lengthwise along the blade and distribute the pressurized gas transversely across a width of the blade, whereby material loosened by the blade is blown away from an end of the blade by the stream of the pressurized gas.

* * * * *